United States Patent [19]

Davis et al.

[11] 4,080,302

[45] Mar. 21, 1978

[54] LUBRICANT COMPOSITIONS CONTAINING ORGANIC HYDROPEROXIDES

[75] Inventors: Robert Hall Davis, Pitman; John William Schick, Cherry Hill, both of N.J.

[73] Assignee: Mobil Oil Corporation, New York, N.Y.

[21] Appl. No.: 791,262

[22] Filed: Apr. 27, 1977

[51] Int. Cl.[2] ..... C10M 3/06; C10M 1/38; C10M 3/32; C10M 5/22

[52] U.S. Cl. ..... 252/31; 72/42; 252/45; 252/52 R

[58] Field of Search ..... 252/31, 45, 52 R; 72/42

[56] References Cited

U.S. PATENT DOCUMENTS

| | | | |
|---|---|---|---|
| 2,470,276 | 5/1949 | Watkins | 252/52 R |
| 2,941,945 | 6/1960 | Fairman et al. | 252/31 |
| 3,130,159 | 4/1964 | Stedt | 252/31 |
| 3,919,093 | 11/1975 | Davis et al. | 252/31 |
| 3,933,658 | 1/1976 | Beiswanger et al. | 252/31 |

*Primary Examiner*—Delbert E. Gantz
*Assistant Examiner*—Irving Vaughn
*Attorney, Agent, or Firm*—Charles A. Huggett; Raymond W. Barclay; Thomas S. Szatkowski

[57] ABSTRACT

Lubricant, particularly metal working, compositions which contain, in an amount sufficient to impart improved load carrying ability, sulfur and an organic hydroperoxide are provided.

11 Claims, No Drawings

LUBRICANT COMPOSITIONS CONTAINING ORGANIC HYDROPEROXIDES

BACKGROUND OF THE INVENTION

1. Field of the Invention

This invention relates to lubricant compositions having improved load carrying, antiwear and extreme pressure properties. In one of its aspects, the invention relates to lubricant compositions in the form of such organic media as oils of lubricating viscosity and greases thereof to which it is desired to impart such properties. Of particular significance is the improvement in a wide variety of metal working fluids, which include both the oleaginous, aqueous and emulsion types. Such metal working fluids are generally utilized for lubricating metals during processing operations such as grinding, drawing, rolling, cutting, forging and the like.

2. Description of the Prior Art

U.S. Pat. No. 2,470,276 of Watkins teaches that the presence of even small amounts of elemental sulfur in petroleum oils is highly objectionable because of its corrosive action with respect to copper and that a number of processes are available for the removal of sulfur from such oils. Since such processes are not completely effective in removing sulfur, Watkins provides a method for inhibiting sulfiding of metallic copper by the sulfur present in petroleum oils. Briefly, the method includes incorporating small amounts, e.g., 0.006 to .2 volume percent, of a hydrocarbon hydroperoxide, such as tertiary butyl hydroperoxide into the oil in order to inactivate the sulfur contained therein.

The petroleum compositions disclosed by Watkins as non-corrosive to copper contain 0.034 weight percent sulfur and 0.006 to .2 volume percent hydroperoxide. The Watkins compositions are different from those disclosed and claimed herein in that they contain different types and amounts of sulfur and do not exhibit the improved load carrying properties as do the compositions of the present invention.

In U.S. Pat. No. 3,012,967, Leonardi et al. teach the stabilization of mineral lubricating oils against the deleterious effects of oxidation by incorporating therein a small amount of each of (1) an aromatic hydroperoxide having a hydroperoxy group attached to an alpha carbon atom of an aryl nucleus thereof, and (2) an acid whose dissociation constant in water is at least about 1.0 $\times 10^{-5}$.

As one skilled in the art would be aware, the acid present in the Leonardi compositions would readily react with the aromatic peroxides to form phenols. The conversion of cumene hydroperoxide into phenol is described in Morrison and Boyd, *Organic Chemistry, Second Edition,* (Boston : Allyn and Bacon, Inc., 1970), page 794. Such reaction would not occur in the compositions of the present invention, since no acid is present. Further, Leonardi does not disclose the incorporation of sulfur into the described compositions.

Finally, in U.S. Pat. No. 3,607,748, Wilson et al. provide a process for preparing lubricating oil compositions which have improved oxidation resistance. The process taught therein comprises (1) oxidizing a hydrocarbon material with an oxidant and (2) contacting the oxidized hydrocarbon material from step (1) with hydrogen sulfide. In carrying out the oxidizing step, oxidants such as oxygen (including air) and an organic hydroperoxide are utilized. When organic hydroperoxides are employed, they are blended into the hydrocarbon material in concentrations of from about .2 to about 10 moles of hydroperoxide per mole of oxygen incorporated into the hydrocarbon material. The Wilson et al. process increases the oxygen content of the hydrocarbon material from about .10 to about 10 percent, by weight.

In Ellis, *The Chemistry of Petroleum Derivatives,* (New York : The Chemical Catalog Company, 1934), page 900 it is taught that peroxides, such as produced by step (1) of the Wilson et al. process, react with reducing agents (hydrogen, hydrogen sulfide, mercaptans) to form either glycols or substituted ethylene oxides. Thus, in order to stabilize oils against future oxidation, Wilson teaches first oxidizing those compounds present in the oil which would be susceptible to oxidation. Next, the deleterious peroxide and hydroperoxides produced are converted to glycols or substituted ethylene oxides.

Wilson, as does Leonardi et al., provides for the incorporation of hydroperoxides into lubricants only to serve as a starting material for further in situ reactions. Such is not the situation in the present invention, where the presence of the sulfur and hydroperoxide in the lubricant composition impart unexpected load carrying ability.

SUMMARY OF THE INVENTION

Metal working fluids are used by flowing over the tool and the work in a steady stream, and function to dissipate the heat from both the tool and the work; improve tool life; improve the quality of the surface produced; lubricate the surfaces in contact between the tool and the work; wash away the chips; decrease tool wear; decrease friction between chip and tool; and provide lubrication between the chip and the tool, thus reducing the effect of the high pressure of the chip on the tool. There is ordinarily an enormous pressure exerted between the cutting edge of the tool and the metal being machined and in addition, due to the inherent resiliency of the metal, heavy pressures are maintained between the work and the surface of the tool just under the cutting edge and between the chips and the surface of the tool just back of the cutting edge. Therefore, it is requisite that a lubricant be provided which is capable of affording a high load-carrying lubricant film between the cutting tool, chip and the work being machined.

It has now been found that improved load carrying, antiwear and extreme pressure properties are imparted to lubricant compositions by the presence of (1) an organic hydroperoxide and (2) sulfur.

The organic hydroperoxide suitable for use in the compositions of this invention are, in general, of the formula:

$$R—OOH$$

where R is a hydrocarbyl group which contains from about 2 to about 46 carbon atoms. In particular R may be alkyl, including cycloalkyl, aryl, aralkyl and alkenyl. The R group may be straight or branched and the hydroperoxide attachment may be to a carbon atom which is either primary, secondary or tertiary.

Among the cycloalkyl hydroperoxides contemplated for use in the compositions of this invention are those having the formula:

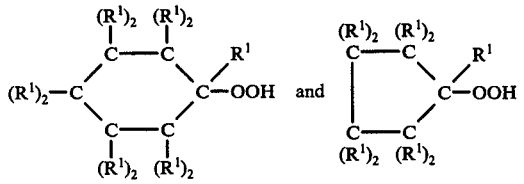

where $R^1$ is hydrogen or an alkyl group containing from about 1 to about 4 carbon atoms. The $R^1$ groups may all be the same or different.

Preferred organic hydroperoxides are those having the formula:

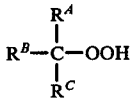

where $R^A$, $R^B$ and $R^C$ are hydrocarbyl groups, each containing from about 1 to about 15 carbon atoms, or hydrogen; however, at least one of $R^A$, $R^B$ and $R^C$ must be hydrocarbyl.

The $R^A$, $R^B$ and $R^C$ hydrocarbyl groups may be alkyl, including cycloalkyl, akenyl, aryl, aralkyl and include both straight and branched chain groups. The $R^A$, $R^B$ and $R^C$ hydrocarbyl groups may be the same or different. In particular, the $R^A$, $R^B$ and $R^C$ hydrocarbyl groups may be selected from, but not limited to, the following: methyl, ethyl, propyl, butyl, pentyl, hexyl, heptyl, isopropyl, iso-butyl, iso-pentyl, iso-hexyl, phenyl, cyclopentyl, and cyclohexyl. Particularly preferred are those hydroperoxides in which the $R^A$, $R^B$ and $R^C$ groups are hydrocarbyl, each containing from about 1 to about 10 carbon atoms, or hydrogen; however, at least one of $R^A$, $R^B$ and $R^C$ must be hydrocarbyl. The chain lengths of the various R groups can be adjusted to provide maximum solubility in either the oleagineous or aqueous fluids, as is known in the art.

Most particularly preferred are the organic hydroperoxides: cumene hydroperoxide, which has the formula:

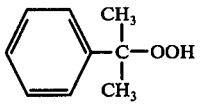

and tert-butyl hydroperoxide, which has the formula:

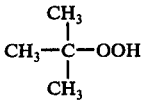

The sulfur suitable for use in the compositions of this invention include elemental sulfur and sulfur-containing organic compounds. Thus, the term "sulfur" as used herein includes both the elemental sulfur and the sulfur containing organic compounds as described hereinafter. Insofar as elemental sulfur is concerned, this is intended to include crystalline, amorphous or collodiol sulfur powders having any of the several allotrophic forms such as $S_6$, $S_8$, or polymeric sulfur, as well as flowers of sulfur.

The useable organic sulfur containing compounds are alkyl sulfides in which the alkyl groups have from about 1 to about 20 carbon atoms, including dialkyl and disulfides; unsymmetrical alkyl sulfides, disulfides and polysulfides. Aromatic sulfides, which contain from 12 to about 20 carbon atoms, such as phenyl sulfides, substituted aryl polysulfides, and dibenzyl disulfides may also be employed. Also, sulfurized fats may be utilized. Excluded are reducing agents such as $H_2S$ and mercaptans. Also excluded are sulfur-containing acids.

Sulfur compounds used in metal working fluids are often classified as "loosely" or "tightly" bound. "Loosely" bound sulfur is defined as that which will cause the corrosion of copper. Included in this category are elemental sulfur, sulfurized terpenes and organic polysulfides. "Tightly" bound sulfur, of which dibenzyl disulfide is representative, does not promote the corrosion of copper.

Tightly bound sulfur is not as effective in imparting extreme pressure properties to a lubricant composition as is loosely bound sulfur. However, it may be utilized in the compositions of this invention. The tightly bound sulfur may be employed either alone or in combination with loosely bound sulfur. If the tightly bound sulfur is utilized alone, it must be employed in greater quantities than are used for the loosely bound. This is known in the art.

The above described organic hydroperoxide and sulfur may be incorporated in the lubricant composition in an amount effective for imparting the desired load carrying, antiwear and extreme pressure improvement. In most applications, these compounds are generally employed in an amount of organic hydroperoxide from about 0.05 to about 20 percent by weight, with from about 0.4 to about 10 percent by weight being preferred, and from about 0.5 to about 2 percent by weight being particularly preferred; and in an amount of sulfur from about 0.05 to about 10 percent by weight, with from about 0.1 to about 9.0 percent by weight being preferred, and from about 0.3 to about 1.0 percent by weight being particularly preferred. Compositions in which the organic hydroperoxides are employed in a weight ratio of hydroperoxide/sulfur of from about 0.1/1 to about 5/1, and particularly from about 1/1 to about 3/1, are most particularly preferred.

If the tightly bound sulfur described hereinabove is utilized alone, it is contemplated that they be employed in amounts from at least about 0.5 percent by weight to about 10 percent by weight, with from about 1 to about 7 percent by weight being preferred.

A field of specific applicability of the present invention is the improvement in load carrying, antiwear and extreme pressure properties of oleaginous materials which include mineral or synthetic oils or greases in which any of the aforementioned oils are employed as a vehicle. In general, the mineral oils, both paraffinic, naphthenic and mixtures thereof, which are employed as the lubricant, or grease vehicle, may be any suitable lubricating viscosity range, as for example, from about 45 SUS at 100° F to about 6000 SUS at 100° F, and preferably from about 50 to about 250 SUS at 210° F. These oils may have viscosity indexes varying from below zero to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation. A wide variety of materials may be employed as thickening or gelling agents. These may include any of the conventional metal salts or soaps, which are dispersed in the lubricating vehicle in grease-forming quantities in such degree as to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects any material which is normally employed for thickening or gelling hydrocarbon fluids for forming grease can be used in preparing the aforementioned improved grease in accordance with the present invention.

In instances where synthetic oils, or synthetic oils employed as the vehicle for the grease, are desired in preference to mineral oils, or in combination therewith, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-dethyl hexyl) subacate, di(2-ethyl hexyl) adipate, dibutyl phthalate, fluorocarbons, silicate esters, silanes, esters of phosphorus-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis (p-phenoxy phenyl) ether and phenoxy phenylethers.

Particularly contemplated among the metal working compositions of the present invention are aqueous fluids, emulsions and oleaginous fluids. The aqueous fluids generally comprise water to which various additive materials are dissolved. The primary use for such materials is coolants for metal working operations. Typical additives include known rust preventives. In addition, additives which lower the surface tension of the water, i.e., surfactants, may also be employed. Although both cationic detergents such as quaternary ammonium compounds, amine salts, and other nitrogeneous bases, and anionic detergents such as secondary alkyl sulfates and alkali metal or alkaline earth metal sulfonates can be employed, the suitable monionic detergents are based on polyoxyalkylenes and include polyoxyethylene dioleate, polyoxyethylene stearate, polyoxyethylene monobutyrate, polyoxyethylene monobutyl ether, polyoxyethylene dimonyl phenol ether, polyoxyethylene sorbitan monooleate, polyoxyethylene t-octyl ether, and others which have been described in the literature.

Emulsions are known in the art by many names including water miscible fluids, water soluble oils, or emulisifiable cutting fluids and generally comprise a suspension of oil droplets in water. These fluids are made by blending the oil, which may generally be of the same type as oleaginous materials as described above, with water and emulsifying agents. The most common emulsion contains a paraffinic or naphthenic mineral oil which generally ranges in viscosity from 100 to 500 SUS at 100° F. Common emulsifiers include petroleum sulfonates, amine soaps, rosin soaps and naphthenic acids.

The oleaginous fluid bases include oils derived from petroleum, i.e., the mineral oils described above, plus oils which are animal, marine or vegetable in origin. These latter oils may be utilized alone or in combination.

It is understood, however, that all of the compositions contemplated herein can also contain other materials, for example, corrosion inhibitors, viscosity index agents, antioxidants, and the like can be used. These materials do not detract from the value of the compositions of this invention, rather they serve to impart their customary properties to the particular compositions in which they are incorporated.

DESCRIPTION OF SPECIFIC EMBODIMENTS

The following non-limiting examples are provided to illustrate the unexpectedly high load carrying ability exhibited by the compositions of the present invention.

The compositions were tested by a Tapping Efficiency Test. In general, the procedure of this test involves measurement of torque developed in an internal threading operation employing SAE 1020 hot-rolled steel. In this test, thirty torque values are obtained with the test fluid and compared with thirty reference fluid values to obtain % Tapping Efficiency, e.g., $$\% \text{ Tapping Efficiency} = \frac{\text{Average of 30 Reference Fluid Torque Values} \times 100}{\text{Average of 30 Test Fluid Torque Values}}$$

The reference fluid employed in the aforementioned test comprised, by weight, 94% sulfurized mineral oil, 3% corrosive sulfurized fat and 3% oxidized $Ca/P_2S_5$ cutting fluid additive.

The ability of a cutting oil to operate efficiently is measured by this tapping test, wherein a series of holes is drilled in a test metal such as SAE 1020 hot-rolled steel. The holes are tapped in a drill press equipped with a table which is free to rotate on ball-bearings about the center. A torque arm is attached to this "floating table" and the arm in turn activates a spring scale, so that the actual torque during the tapping, with the oil being evaluated, is measured directly. The same conditions used in evaluating the test oil are employed in tapping with a strong oil which has arbitrarily been assigned an efficiency of 100%. The average torque in the test oil is compared to that of the standard and a relative efficiency is calculated on a percentage basis. For example,

| | |
|---|---|
| Torque with standard reference oil | 19.3 |
| Torque with test oil | 19.8 |
| Relative efficiency of test oil 19.3/19.8 × 100 | 97.4 |

This test described by C. D. Fleming and L. H. Sudholz in Lubrication Engineering, volume 12, No. 3, May-June 1956, pages 199 to 203, and also in U.S. Pat. No. 3,278,432.

It should be noted, in accordance with the foregoing Tapping Efficiency Test that if the test fluid torque values exceed the reference value, Tapping Efficiency is below 100%. Criteria for product acceptance are evaluated as follows:

| Tapping Efficiency | Comments |
|---|---|
| >100% | Fluid considered out-Standing and should outperform reference product in severe cutting operations. |
| 80-100% | Acceptable range for moderate duty cutting fluids |
| <80% | All products with Tapping Efficiencies below 80% are considered unacceptable. Torque values are erratic, frequently due to tap sticking and/or breakage. |

EXAMPLES

Small amounts of organic hydroperoxides were added to a base oil and the resulting compositions were tested for tapping efficiency in the tapping test described above. Table I tests the composition and results.

TABLE 1

TAPPING TEST RESULTS

| | Composition Wt. % | | | | |
|---|---|---|---|---|---|
| Ex. | Cumene Hydroperoxide | tert Butyl Hydroperoxide | Paraffinic Oil* 100 SUS at 100° F | Sulferized Mineral Oil 150 SUS at 100° F (.68 wt.%, Elemental S | Tapping Efficiency |
| 1 | — | — | 100 | — | Cannot Tap |
| 2 | — | — | — | 100 | 87 |
| 3 | 1.0 | — | 99 | — | Cannot Tap |
| 4 | 0.1 | — | | 99.9 | 93 |
| 5 | 1.0 | — | | 99.0 | 102 |
| 6 | 2.0 | — | | 98.0 | 100 |
| 7 | — | 1.0 | | 99.0 | 102 |

*Contains .2 wt. percent sulfur which was not removed by the refining process

Referring to the data presented in the Table, Example 1 indicates that it is virtually impossible to tap SAE 1020 steel with a paraffinic oil which contains .2 weight percent "natural" sulfur, i.e., not removed by the refining process. Example 3 shows that the addition of 1.0 weight percent cumene hydroperoxide to that oil provides no improvement. The composition tested in Example 3 is similar to those compositions disclosed by Watkins in U.S. Pat. No. 2,470,276 in that the sulfur present in the Watkins compositions is mainly "natural" sulfur. Thus, the Watkins compositions do not exhibit the improved extreme pressure properties as do the compositions of the present invention.

A sulfurized oil, i.e., an oil to which elemental sulfur has been added, is acceptable only for moderate duty machining, as illustrated in Example 2. However, a vast improvement in tapping efficiency is observed when organic hydroperoxides are added to the sulfurized oils, as shown by Examples 4–7. Thus, the lubricant compositions of the present invention, represented by Examples 4–7 in the above table, are suitable for the most severe metalcutting operations.

We claim:

1. A lubricant composition which comprises: a lubricant selected from the group consisting of oils of lubricating viscosity, greases thereof and metalworking fluids, and, in an amount sufficient to impart load carrying properties, sulfur and an organic hydroperoxide having the formula:

R—OOH where R is a hydrocarbyl group which contains from about 2 to about 46 carbon atoms.

2. The composition of claim 1 wherein said organic hydroperoxide is present in an amount from about 0.05 to about 20.00 percent by weight and said sulfur is present in an amount from about 0.05 to about 10.00 percent by weight.

3. The composition of claim 1 wherein said organic hydroperoxide is present in an amount from about 0.50 to about 2.00 percent by weight and said sulfur is present in an amount from about 0.30 to about 1.00 percent by weight.

4. The composition of claim 1 wherein the said organic hydroperoxide and sulfur is present in a weight ratio of hydroperoxide/sulfur from about 0.1/1 to about 5/1.

5. The composition of claim 1 wherein said organic hydroperoxide is cumene hydroperoxide.

6. The composition of claim 1 wherein said organic hydroperoxide in tert-butyl hydroperoxide.

7. The composition of claim 1 wherein said oil of lubricating viscosity comprises a mineral oil.

8. The composition of claim 1 wherein said oil of lubricating viscosity comprises a synthetic oil.

9. The composition of claim 1 wherein said lubricant comprises water.

10. The composition of claim 1 wherein said lubricant comprises an emulsion.

11. A method for cutting a metal which comprises contacting said metal with a lubricant composition which comprises: a lubricant selected from the group consisting of oils of lubricating viscosity, and metalworking fluids, and, in an amount sufficient to impart load carrying properties, sulfur and an organic hydroperoxide having the formula:

R—OOH where R is a hydrocarbyl group which contains from about 2 to about 46 carbon atoms.

* * * * *